US006155763A

United States Patent [19]

Parker et al.

[11] Patent Number: 6,155,763

[45] Date of Patent: Dec. 5, 2000

[54] BOOKBINDING SYSTEM AND METHOD

[75] Inventors: Kevin P. Parker, Berkeley; Christopher J. Rush, San Leandro; Keith A. Wilson, El Cerrito; Eliza Laffin, Emeryville, all of Calif.

[73] Assignee: Powis Parker Inc., Berkeley, Calif.

[21] Appl. No.: 09/270,247

[22] Filed: Mar. 15, 1999

Related U.S. Application Data

[63] Continuation-in-part of application No. 09/146,994, Sep. 4, 1998.

[51] Int. Cl.[7] ..... B42D 3/04; B42C 3/00

[52] U.S. Cl. ..... 412/6; 412/4; 412/5; 412/8; 412/19; 412/21

[58] Field of Search ..... 412/4, 5, 6, 8, 412/19, 21

[56] References Cited

U.S. PATENT DOCUMENTS

| | | | |
|---|---|---|---|
| 1,525,688 | 2/1925 | Page | 281/34 |
| 3,572,767 | 3/1971 | Learned et al. | 281/34 |
| 4,355,822 | 10/1982 | McHugh | 281/34 |
| 4,800,110 | 1/1989 | DuCorday | 412/6 |

*Primary Examiner*—A. L. Wellington
*Assistant Examiner*—Mark T. Henderson
*Attorney, Agent, or Firm*—Limbach & Limbach L.L.P.

[57] ABSTRACT

A bookbinding system and method of binding books including a cover/spine assembly having a relatively rigid cover section with a length and width at least as great as that of the stack of sheets to be bound and a spine section having a width greater than the height of the stack. The cover/spine assembly and the spine section are secured together along the length of the cover section so that the spine section can be folded along a first edge with respect to the cover/spine assembly. A heat activated matrix is disposed on the spine section including a central adhesive band and an outer band disposed between the central adhesive band and a second edge of the spine section. Binding is carried out by placing the stack over the cover section and folding the spine section over the edge of the stack. Preferably a second relatively rigid cover section is placed on top of the stack so that the outer adhesive band on the spine section will extend over second cover section. The central adhesive band is a low viscosity adhesive which, when activated, bonds the sheets of the stack to the spine section to form the spine of the bound book. The outer adhesive band, when activated, bonds the second cover to the spine section thereby forming a hardcover book having the feel and appearance of a book bound using conventional techniques.

21 Claims, 14 Drawing Sheets

BOOKBINDING SYSTEM AND METHOD

CROSS-REFERENCE TO RELATED APPLICATIONS

The present application is a Continuation-In-Part Application of application Ser. No. 09/146,994 filed on Sep. 4, 1998.

BACKGROUND OF THE INVENTION

1. Field of the Invention

The present invention relates generally to the field of bookbinding and, in particular, to a bookbinding system which utilizing a substrate having an adhesive coating, with the substrate forming the spine and front cover of the book.

2. Description of Related Art

Binding systems using a binding strip are well known as exemplified by U.S. Pat. No. 4,496,617. One disadvantage of the binding strip system is that specialized equipment is needed to print information on the strip. Other types of binding systems incorporate a wrap around cover which includes what will be the front cover, the back cover and the spine of the bound book. Such a binding system is disclosed in U.S. Pat. No. 4,289,330. One disadvantage of the wrap around cover binding system is that different thicknesses of stacks of pages to be bound require different sizes of wrap around covers.

In addition, conventional binding systems capable of use with relatively inexpensive using desktop binding machines produce bound books having soft covers. In some instances, there is a need for a low cost binding system that can produce a bound book having hard covers.

The present invention overcomes the above-noted shortcomings of the prior art. The binding system in accordance with the one embodiment of the present invention includes front, rear and a spine sections, all of which can be printed using a conventional desk top ink jet. Further, a single size embodiment of the subject binding system can accommodate a relatively wide range of book thicknesses. Further, a second embodiment of the present invention permits a hardcover book to be produced using conventional desktop bookbinding machines. These and other advantages of the present invention will become apparent to those skilled in the art upon a reading of the following Detailed Description of the Invention together with the drawings.

SUMMARY OF THE INVENTION

A bookbinding system and method of binding a stack of sheets is disclosed. The system includes a cover/spine assembly comprising a relatively rigid cover section and a spine section. The cover section has a width and length at least as great as the length and width of the stack to bound. The spine section has a length that corresponds to the length of the first cover section and a width which is greater than the height of the stack.

A first edge of the spine section is secured to a first edge of the cover section along the length of the cover section so that the spine section can be folded with respect to the cover section. An adhesive matrix is disposed on the spine section, which includes a central adhesive band extending along the length of the spine section, with the central adhesive band being a heat-activated, relatively low viscosity adhesive. The matrix further includes an outer adhesive band extending along the length of the spine section intermediate the central band and a second edge of the spine section, opposite the first edge.

A stack is bound by placing the stack over the cover section and folding the spine section over the edge of the stack. Preferably, a second relatively rigid cover section is placed over the stack, with a portion of the folded spine section being positioned over the second cover section. The assembly is placed in a conventional desk top binding machine which operates to activate the central adhesive so that the edge of the stack will be able to absorb the low viscosity adhesive and to activate the outer adhesive band so that the spine section will be bonded to the second cover section. A bound book will result simulating the feel and appearance of a hardcover book bound using conventional techniques.

DETAILED DESCRIPTION OF THE INVENTION

Figure 1:
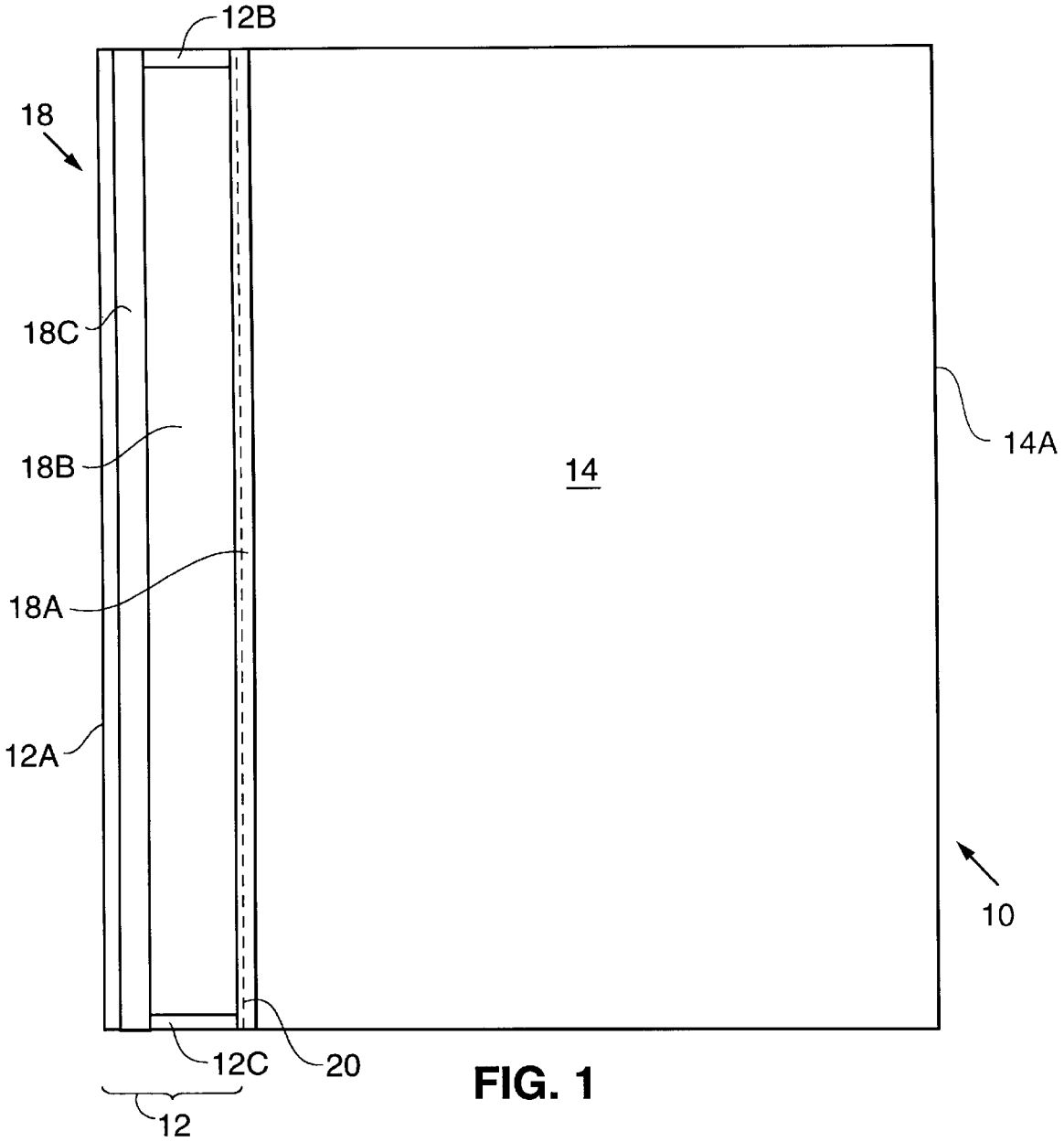
FIG. 1 is a plan view of the cover/spine assembly of a first embodiment of the subject binding system prior to binding.
Figure 2:
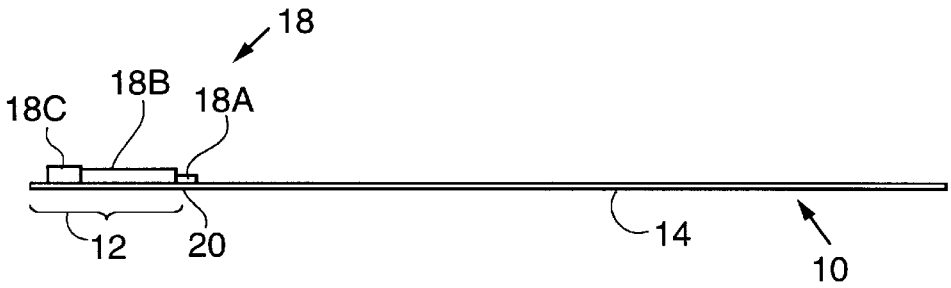
FIG. 2 is a side elevational view of the cover/spine assembly showing some of the details of the adhesive matrix.

Referring to the drawings, FIG. 1 is a plan view of the interior of a cover/spine assembly, generally designated by the numeral 10, of a first embodiment bookbinding system used to bind a stack of sheets to form a bound book. Assembly 10 includes a spine section 12 and an integral cover section 14 formed from a single sheet of heavy weight paper stock. A crease 20 (not depicted) is formed in the sheet of paper stock thereby dividing the stock into the spine and cover sections 12 and 14, respectively. As is well known, crease 20 can be formed by passing paper stock between a pair of rollers, with one of the rollers having a protrusion which extends into a groove formed in the second roller. The roller with the protrusion passes over the underside of the stock as viewed from FIG. 1 so that the crease appears as an indentation on the exterior side of the assembly 10. Cover section 14 typically has the same outer dimensions as the sheets to be bound or is slightly larger.

Figure 4:
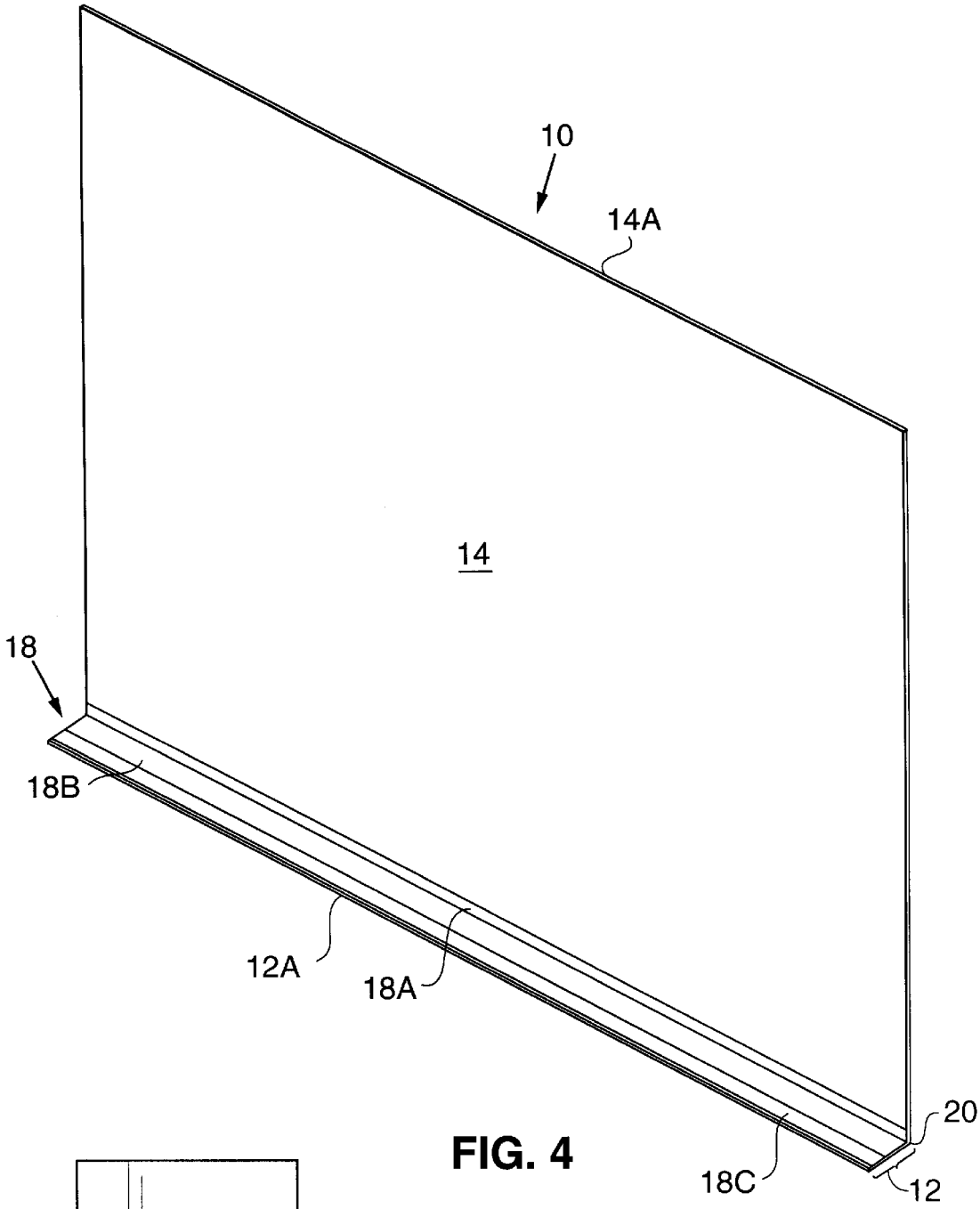
FIG. 4 is a perspective view of the cover/spine assembly with the first fold in the assembly being formed.

Referring also to FIG. 4, the cover/spine assembly 10 includes an adhesive matrix 18 formed on the interior side of paper stock. Matrix 18 includes an inner adhesive band 18A which extends along the full length of crease 20 from the top to the bottom of the cover spine assembly 10. The adhesive properties of inner adhesive band 18A can be the same as those of the central adhesive band, which will be described. Inner band 18A is typically ⅛ inch wide and can be very thin, such as 0.005 inches thick. Although not shown in the drawings, it is preferred that a thin layer, typically 0.003 inches, of high viscosity adhesive be applied to the spine section 12 prior to application of the remainder of the adhesive matrix. An adhesive sold under the designation HB HL-1777 by the H. B. Fuller Company of St Paul, Minn. has been found suitable for this purpose. The thin, high viscosity layer functions to act as a barrier which eliminates the tendency of the low viscosity adhesive of band 18B to pass through the spine section 12 and thereby becoming visible on the exterior of the bound book. The barrier layer also has been found to prevent all of the low viscosity adhesive of band 18B from being drawn up between the sheets thereby ensuring that a portion of the adhesive remains to reliably secure the spine section 12 to the bottom edge of the stack 22.

Central adhesive band 18B, which is the primary adhesive for binding the sheets of stack 22, has an inner edge which extends up to and along crease 20. This is important since, as will be explained, the central adhesive band 18B must be able to contact the edges of all of the sheets to be bound, including sheets located near crease 20. Band 18B is a low viscosity, heat-activated adhesive. An adhesive made by National Starch & Chemical Company of Bridgewater, N.J. under the designation Cool-Bind 34-1301 has been found suitable for inner band 18A. Central adhesive band 18B is preferably approximately 0.015 inches thick and, as will be described later in greater detail, is at least as wide as the thickness of the stack of sheets to be bound. As can best be seen in FIG. 1, central band 18B preferably extends over slightly less than the full length of the spine section 12 so that gaps 12B and 12C in the adhesive are present at both ends of the band.

Outer band 18C is positioned adjacent the central adhesive band 18B and is preferably of approximately the same thickness as inner band. The outer band 18C is also preferably displaced from the edge 12A of the spine section 12 a fixed distance so that, after the binding sequence, the adhesive will be displaced to edge 12A but no further. The outer edge of adhesive 18C should be no further than 0.5 inches from the edge 12A of the spine section, and preferably less, as previously noted. In addition, it is preferred that the width of the spine section 12 be less than ¼ the width of the cover section 14. An adhesive made by HB Fuller Company of St. Paul, Minn. and marketed under the designation HL-1777 has been found suitable for outer band 18C.

Figure 3:
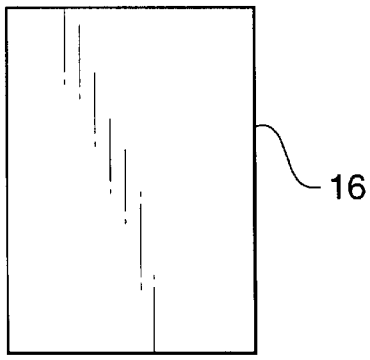
FIG. 3 is a plan view of the rear cover piece of the first embodiment of the subject binding system prior to binding.

FIG. 3 illustrates the rear cover piece 16 which forms the back of the bound book and which is preferably made of the same heavy weight paper stock used in the cover/spine assembly 10. Rear cover piece 16 has the same outer dimensions as the sheets to be bound and as that of the cover section 14 of the cover/spine assembly 10.

Having described the first embodiment cover/spine assembly 10, the manner in which the assembly can be used to bind a stack of sheets will now be described. One advantage of the subject invention is that the actual binding process can be carried out using an existing binding machine of the type which utilizes binder strips. Such a machine is described in U.S. Pat. No. 5,052,873 entitled APPARATUS AND METHOD OF BINDING A BOOK, the contents of which are fully incorporated herein by reference. The binding machine includes apparatus for loading and otherwise manipulating a binder strip which is not needed and which can be temporarily disabled by way of a minor modification. Alternatively, the binder strip sensing mechanism can be triggered by momentarily inserting a binder strip into the strip input of the machine and then removing the strip so the strip will not be fed into the machine. The manner in which a binding machine could be implemented which is dedicated to binding sheets using the subject cover/spine assembly 10 will be readily apparent from the following description.

The binding sequence is initiated by measuring the stack of sheets to be bound and selecting a cover/spine assembly 10 of appropriate dimensions. The different assemblies have the same dimensions except for the width of the spine section 12 which, as previously noted, is defined as that portion of the assembly intermediate crease 20 and edge 12A. As will be explained in greater detail, it is anticipated that a total of only four different dimensioned assemblies 10 need be kept in stock in order to have the capability of binding stacks having a wide range of widths. This is significantly fewer than required in conventional wrap around covers such as described in the previously-noted U.S. Pat. No. 4,289,330. One such prior art product is available in 1/16 inch increments so that a total of twenty-four different cover sizes are needed to bind stacks ranging in thickness from 0 to 1.5 inches.

Figure 5:
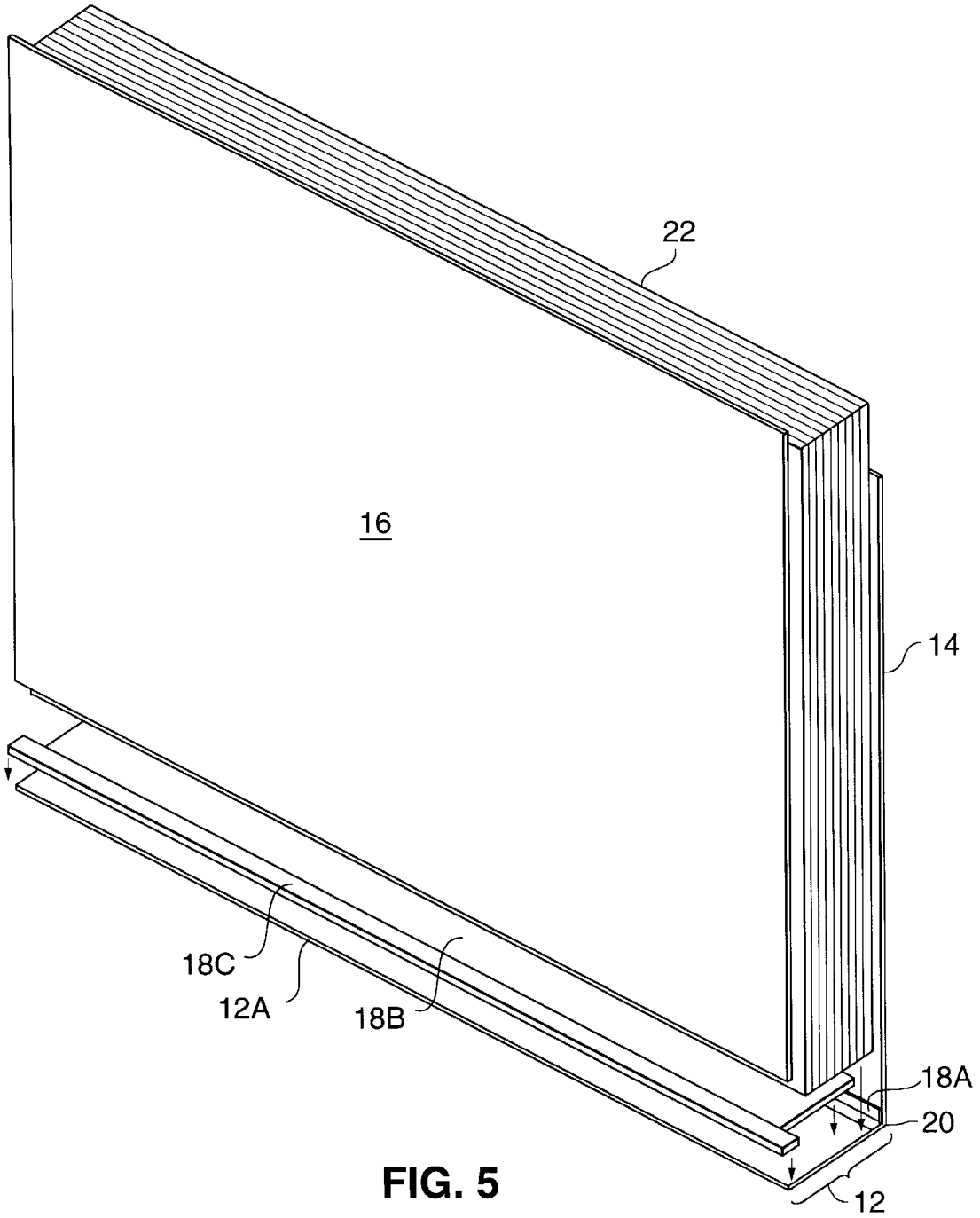
FIG. 5 is a perspective exploded view of the cover/spine assembly and a stack of sheets about to be bound in accordance with the first embodiment of the present invention.
Figure 6:
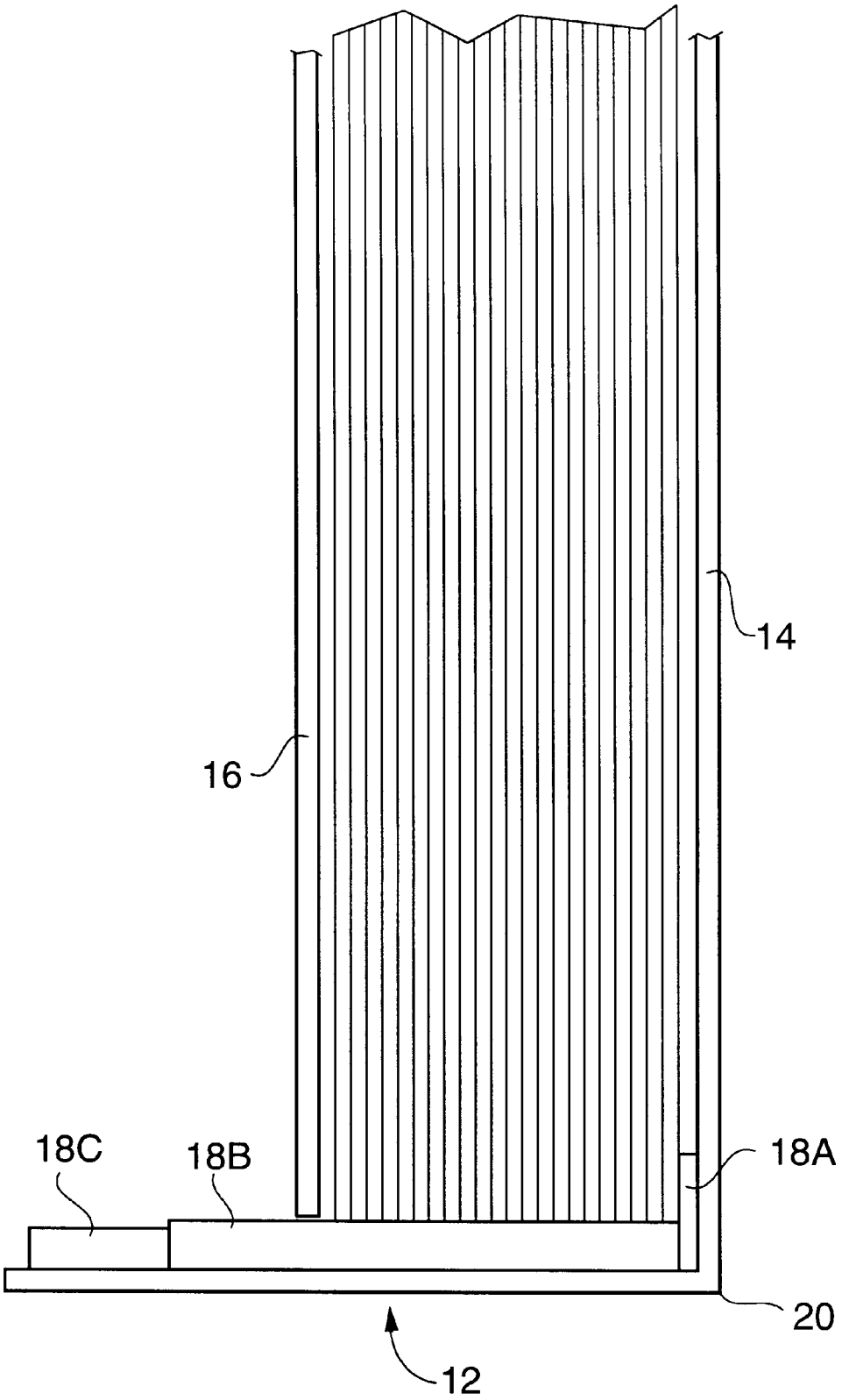
FIG. 6 is a schematic diagram of an end view of a stack after the first fold has been formed and prior to formation of the second fold.

Once the appropriate dimensioned cover/spine assembly 10 has been selected, the assembly in manually folded along crease 20 so that the spine section 12 is approximately at right angles with respect to the cover section as shown in FIG. 4. The stack of sheets 22 are then assembled together with the rear cover piece 16. The stack 22 and rear cover piece 16 are then manually positioned on the spine section 12 as shown in FIGS. 5 and 6. It is preferred that the sheets 22 and cover piece be placed in a conventional jogging machine prior to placement on the cover/spine assembly 10 so that the edges of each individual sheet of the stack 22 will contact the central adhesive band 18B.

Figure 7A:
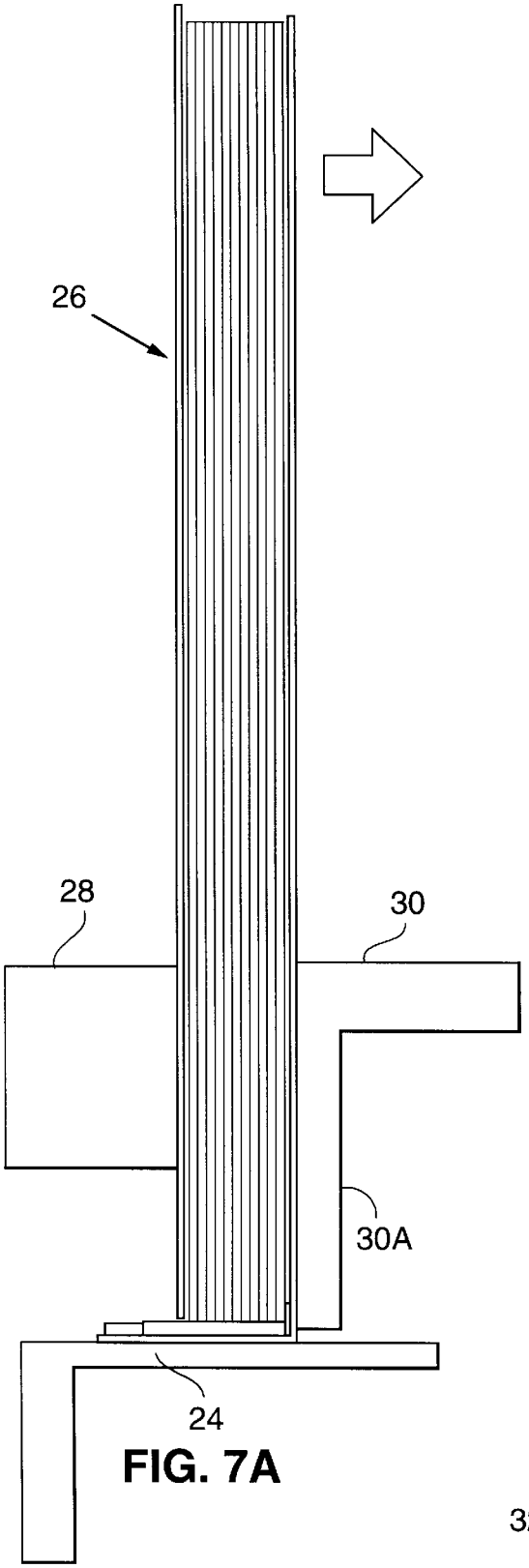
FIG. 7A shows a stack being bound in accordance with the first embodiment of the present invention, with the stack being positioned on a cold platen.

The stack 22, rear cover section 16 and assembly 10, collectively referred to as book 26, are then manually positioned on a cold platen 24 of a binding machine as shown in FIG. 7A. The machine is then actuated thereby causing the book to be gripped between a first support 28 and a second support 30. Second support 30 includes a lower section 30A which is positioned to provide support near the spine of the book 26.

Figure 7B:
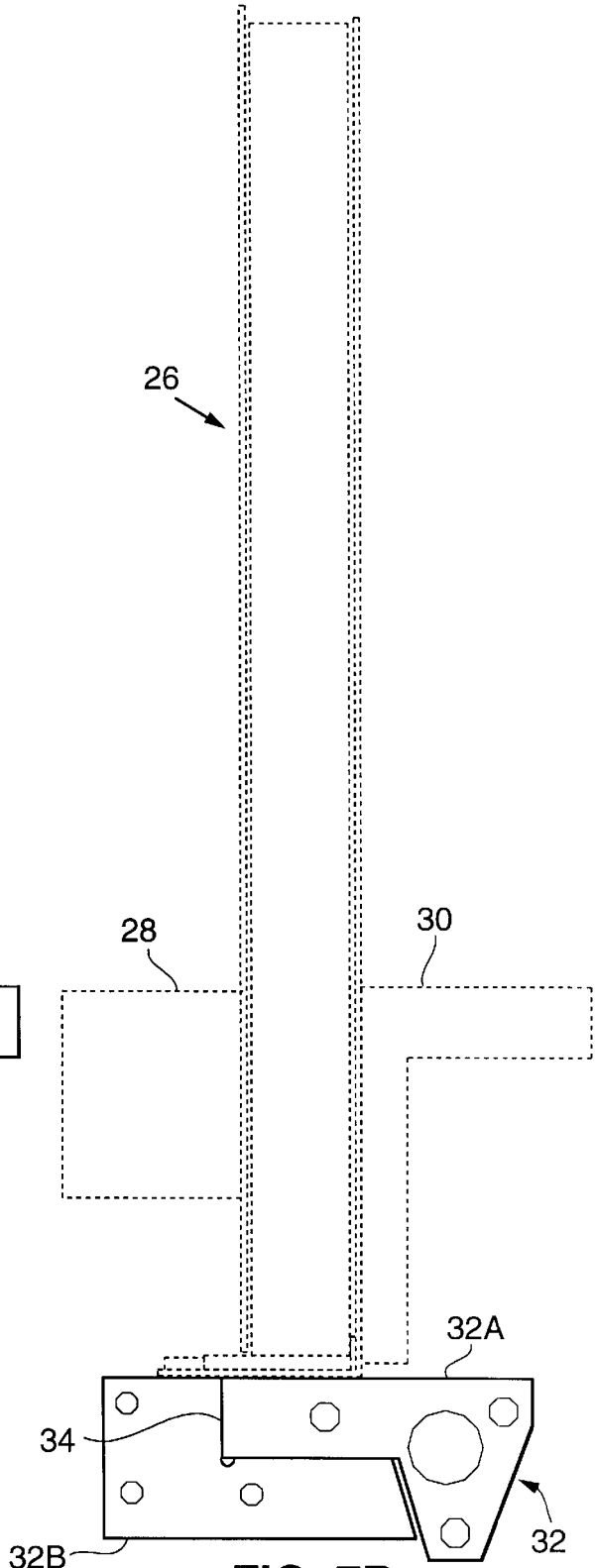
FIG. 7B shows the stack being bound in accordance with the first embodiment of the present invention, with the stack being transferred from the position of FIG. 7A to a position on a heated platen.
Figure 8:
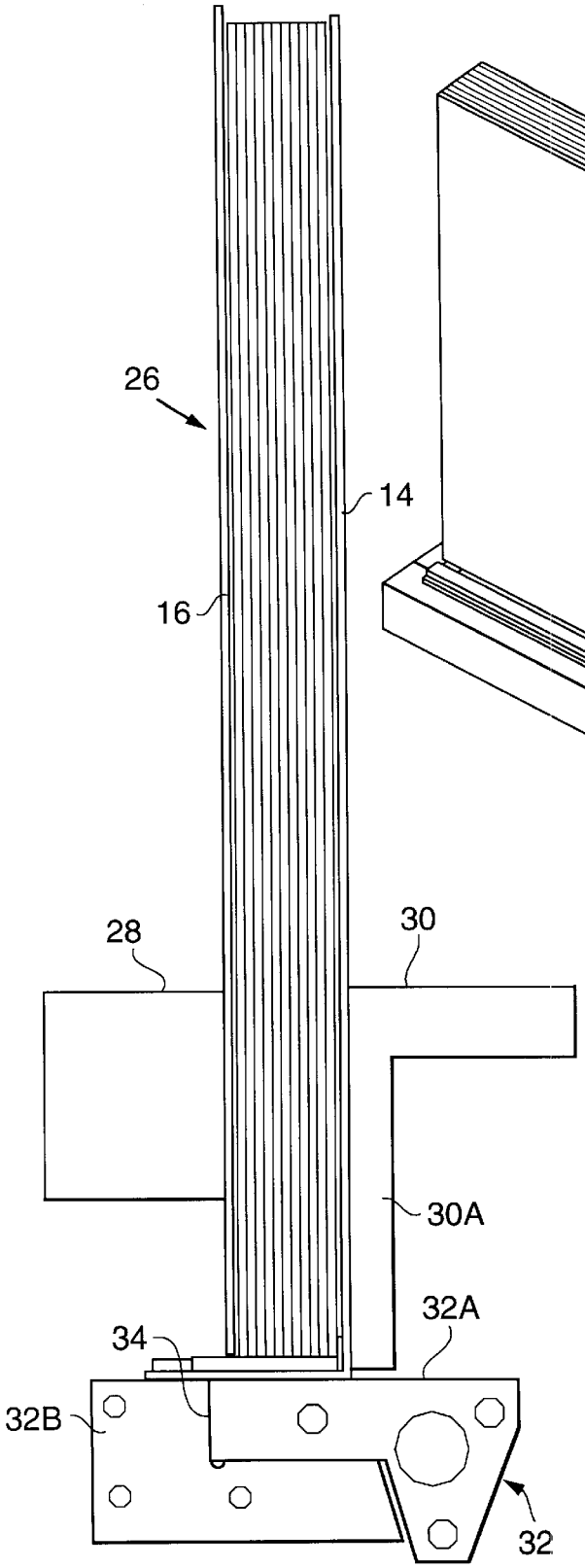
FIG. 8 is similar to FIG. 7B and shows the stack being bound resting on the heated platen.
Figure 9:
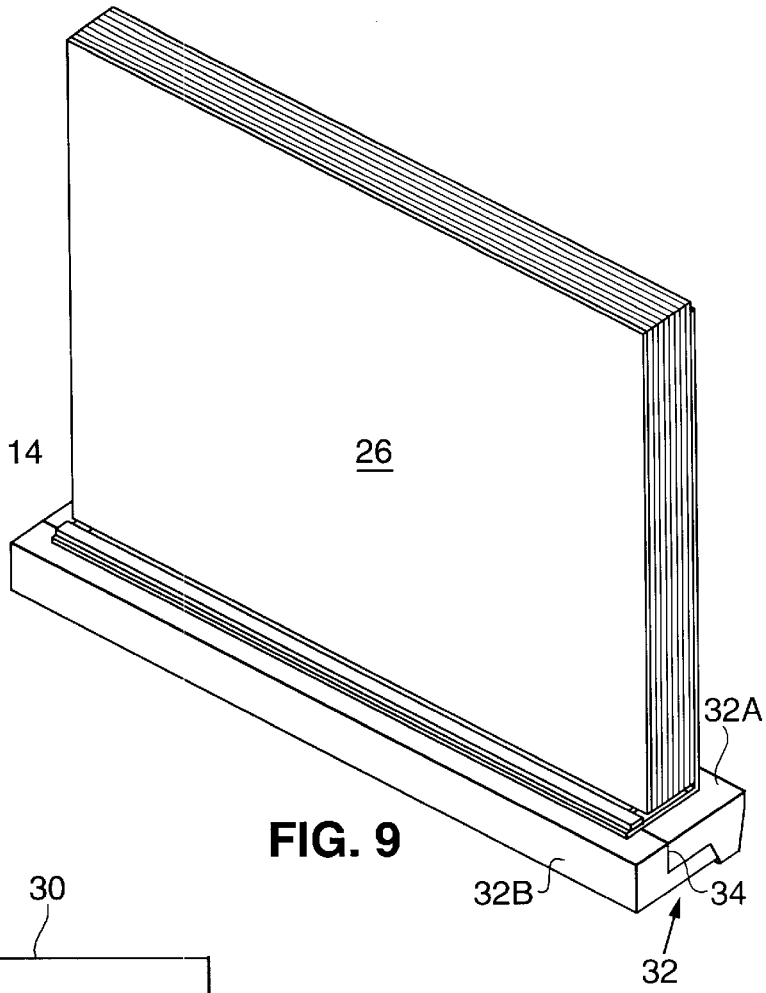
FIG. 9 is a perspective view of the stack resting on the heated platen prior to formation of the second fold in the cover/spine assembly.

Next, book 26 is transferred from the cold platen 24 to a heated platen 32 as shown in FIG. 7B. This is accomplished by moving supports 28 and 30 together so that book 26 remains gripped between the two supports. As can be seen in FIGS. 8 and 9, book 26 is positioned on the heated platen 32 so that the rear cover piece 16 of the book is aligned with the interface 34 between a fixed section 32A of the platen and a rotating section 32B of the platen. Typically, the fixed section 32A is electrically heated to a temperature of approximately 415 to 425° F., with the rotating section being heated by way of conduction by the fixed section.

Book 26 will remain on platen 32 for approximately 10 to 15 seconds so that the central adhesive 18B will have adequate time to become molten. A moderate upward pressure is applied by platen 32 to book 26 so that the molten, low viscosity, central adhesive 18B will contact the edge of each sheet of stack 22. In addition, a small quantity of the adhesive will be drawn up between the individual pages by virtue of capillary action thereby insuring that each page will be adequately bound. The thin inner adhesive band 18A will also be heated by way of conduction though central adhesive 18B and nearby structure so that the adhesive will also be activated.

Figure 11:
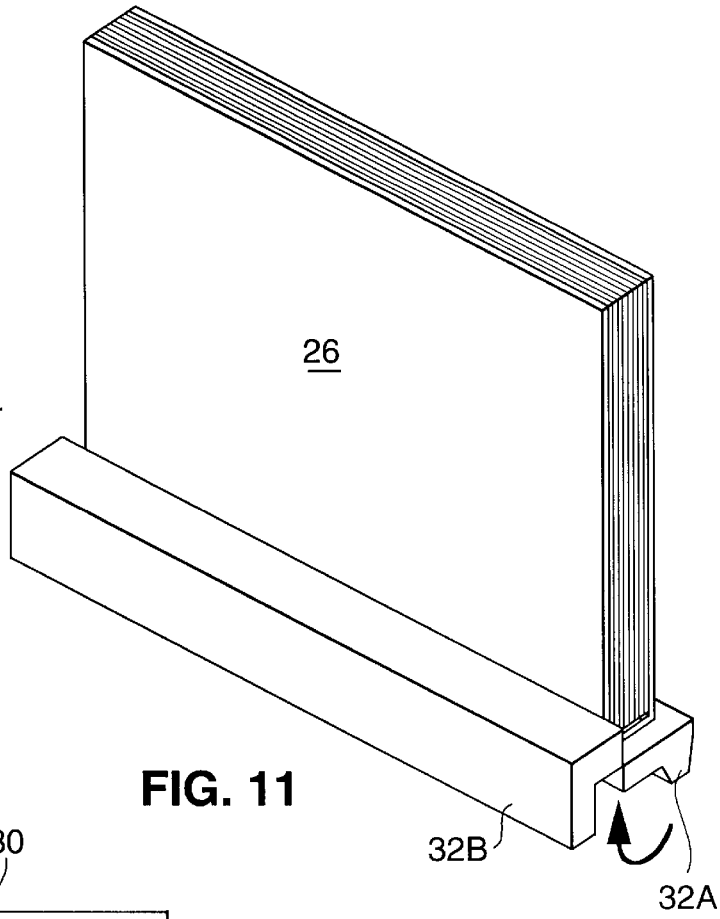
FIG. 11 is a perspective view of the cover/spine assembly showing the stack being bound resting on the heated platen with the pivoting section rotated so as to form the second fold.
Figure 10:
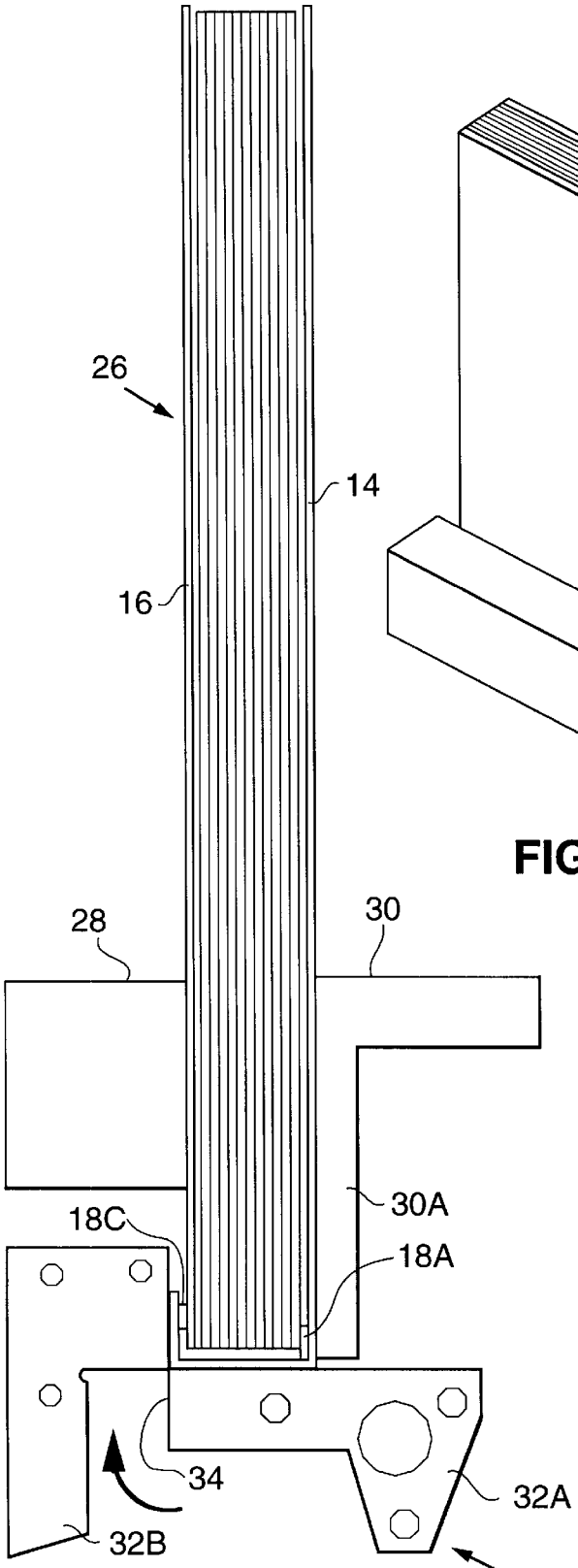
FIG. 10 shows the stack being bound resting on the heated platen, with the pivoting section of the heated platen being rotated so as to form the second fold in the cover/spine assembly.

As shown in FIGS. 10 and 11, rotating section 32B of the heated platen is then rotated 90°. This will cause a portion of the spine section 12 to be folded around the lower edge of the stack so that the outer adhesive band will be forced against rear cover 16. The excess central adhesive 18B, the portion of the adhesive not contacting the edge of the stack, is wrapped around the lower portion of the rear cover piece 16. The rotating section 32B of the platen will cause heat and pressure to be applied to that part of the spine section opposite outer adhesive band 18C, with the lower portion 30A of the second support 30 on the opposite side also operating to apply pressure to the book 26, including the heated inner adhesive band 18A.

Figure 12:
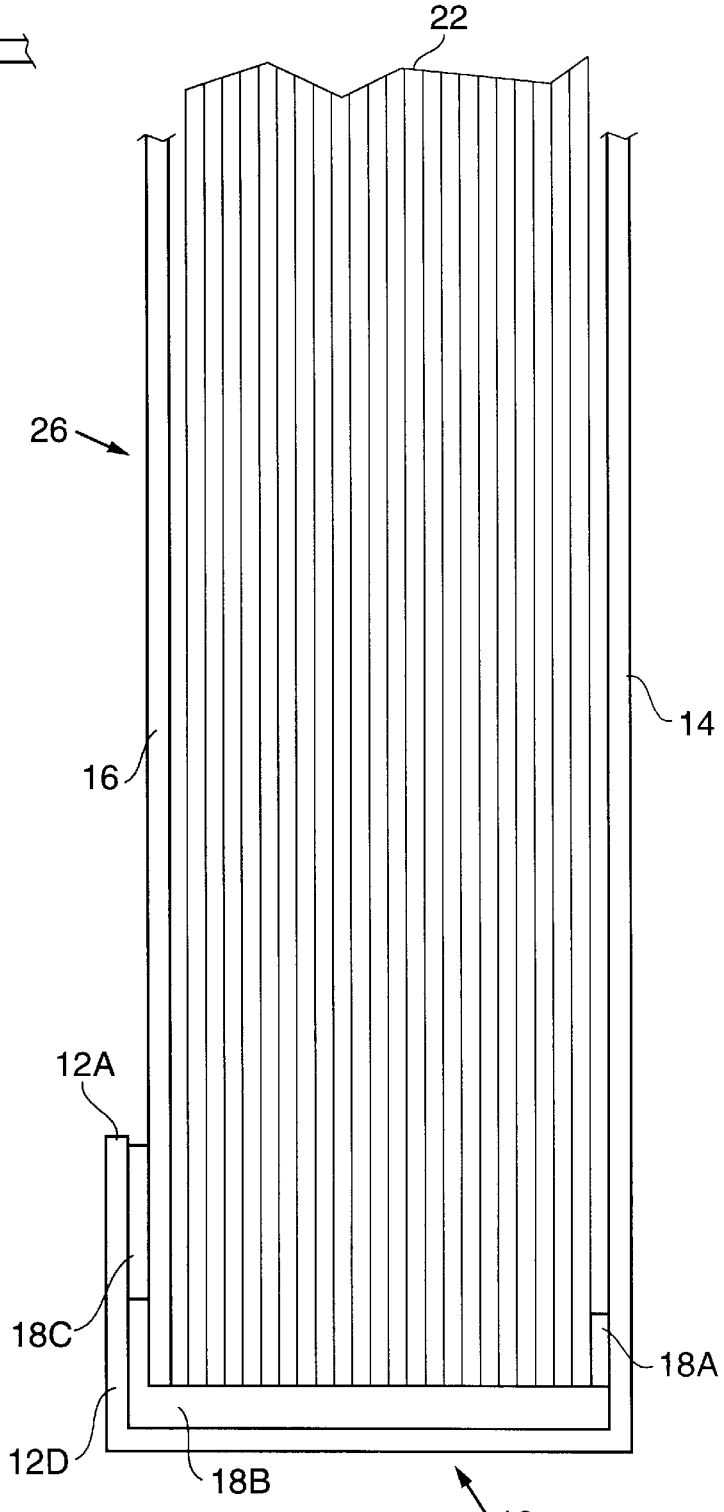
FIG. 12 shows the edge of the book at the end of the binding sequence.

As can best be seen in FIG. 12 which illustrates the final bound book 26, the applied heat and pressure will cause the outer adhesive band 18C to form a bond between the spine section 12 near edge 12A and the rear cover piece 16. Although the FIG. 12 structure (like FIG. 6) is not to scale, with certain dimensions being exaggerated to show certain details more clearly, it can be seen that outer adhesive band 18C is flattened and displaced so that the band extends close to the edge 12A of the spine section 12. Further, although not illustrated in FIG. 12, the thickness of band 18C is actually reduced to the point that the edge 12A actually contacts the rear cover piece 16 thereby forming an relatively continuous surface between the spine section and the rear cover piece. The low viscosity central adhesive band 18C will have flowed up between the individual sheets so that each sheet is secured upon cooling. The voids formed by gaps 12B and 12C in the central adhesive band 18C will receive some of the molten adhesive thereby reducing the likelihood that excess molten adhesive will flow out from under the spine section 12 so as to detract from the appearance of the bound book.

Figure 13:
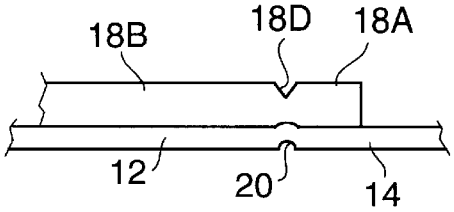
FIG. 13 shows an alternative construction of the adhesive matrix of the first embodiment subject cover/spine assembly.

As previously noted, the edge of central adhesive 18B should be positioned over crease 20 so that the adhesive will contact all of the sheets of the stack 22, including the sheets closest to the cover section 14. However, since the cover/spine assembly will typically be manually folded along the crease, there will always be some inaccuracy in the location of the actual fold line with respect to the crease. An inaccuracy on the order of one or two thicknesses of the sheets being bound is sufficient to prevent each of the sheets from being captured by the central adhesive 18B. Inner adhesive band 18A is present to ensure that the sheets near the cover section 14 will be secured regardless of such inaccuracy. Adhesive band 18A is made thin to facilitate folding along the crease. However, to simplify the manufacturing process, it would be possible to make the central adhesive band 18B and the inner adhesive band 18A the same thickness. As can be seen in FIG. 13, the thickness of the central adhesive band 18B and the inner adhesive band 18A is the same. The two bands are separated by a notch or groove 18D formed in the adhesive over the location of the crease 20 which extends along the length of the inner adhesive band. Thus, the assembly can be more readily folded at the crease 20 by virtue of notch 18D. If there is any misalignment in the fold, inner adhesive band 18A will be present to ensure that the sheets closest to the cover section 14 are secured.

Note that the actual point at which the edge 12A of the spine section contacts the rear cover piece 16 will vary depending upon the width of the stack 22 being bound. A more narrow stack 22 will cause the folded portion 12D of the spine section 12 to extend higher along rear cover section 16. Although one size cover/spine assembly 10 will accommodate a wide range of stack 22 thicknesses, it is important that the folded portion 12D not be so long that the rotating section 32B (FIG. 10) of the heated platen not fully contact the region of the folded portion opposite the outer adhesive band 18C. Thus, for significantly thinner stacks 22, a cover/spine assembly 10 having a more narrow spine section 12 should be selected.

In one existing binding machine, rotating platen section 32B is positioned such that the outer adhesive band 18C must be ⅝ of an inch or less above the lower edge of the book spine (above the fixed platen section 32A) for the rotating platen section to be capable of applying pressure to the folded spine section 12D where outer adhesive band 18C is located. If the outer band 18C is any higher, it cannot be adequately reached by the rotating platen section 32B. Rotating platen 32B extends ⅝ of an inch upwards when in the rotated position shown in FIG. 10. Accordingly, the edge 12A of the spine section should never extend higher along the rear cover 16 than ⅝ of an inch. Table 1 below sets forth the stack 22 widths and the corresponding relative size of cover/assembly 10. It can be seen that for the minimum stack thicknesses of each category, the spine section 12 is sufficiently narrow to ensure that the folded section 12D is no more than ⅝ of an inch.

TABLE 1

| STACK THICKNESS (inches) | ASSEMBLY SIZE (spine section width in inches) |
|---|---|
| 0–⅜ | ⅝ (THIN) |
| ⅜–¾ | 1 (MEDIUM–THIN) |
| ¾–1 ⅛ | 1 ⅜ (MEDIUM WIDE) |
| 1 ⅛–1 ½ | 1 ¾ (WIDE) |

An important aspect of the present invention is that it is possible to add printed matter to the cover/spine assembly 10 and to the rear cover piece 16 prior to binding, including titles and cover designs. Printing can be done using a conventional ink jet printer or a laser printer/copier. This produces an attractive bound book similar in appearance to books produced using much more complex and expensive equipment. In the event a laser printer or copier is to be used, the adhesive matrix must added after the printing process has been completed due to the heat involved in the printing process. This can be done by creating the matrix 18 separate from the cover/spine assembly 10. Once the printing process has been completed, the matrix 18 is manually mounted on the assembly 10 using a pressure sensitive adhesive.

Since laser printers and copiers utilize inks that will be adversely affected by high temperatures, it is important to use heat-activated adhesives in the adhesive matrix 18 which have relatively low activation temperatures. It is also preferable that, subsequent to printing and prior to binding, the cover/spine assembly 10 be covered with a clear plastic laminating film. The film will help prevent the ink from being smeared or distorted by the elevated temperatures used in the binding process. Ink jet printers do not utilize temperature sensitive inks therefor these precautions are only necessary when laser printers/copiers are to be used.

Figure 14:
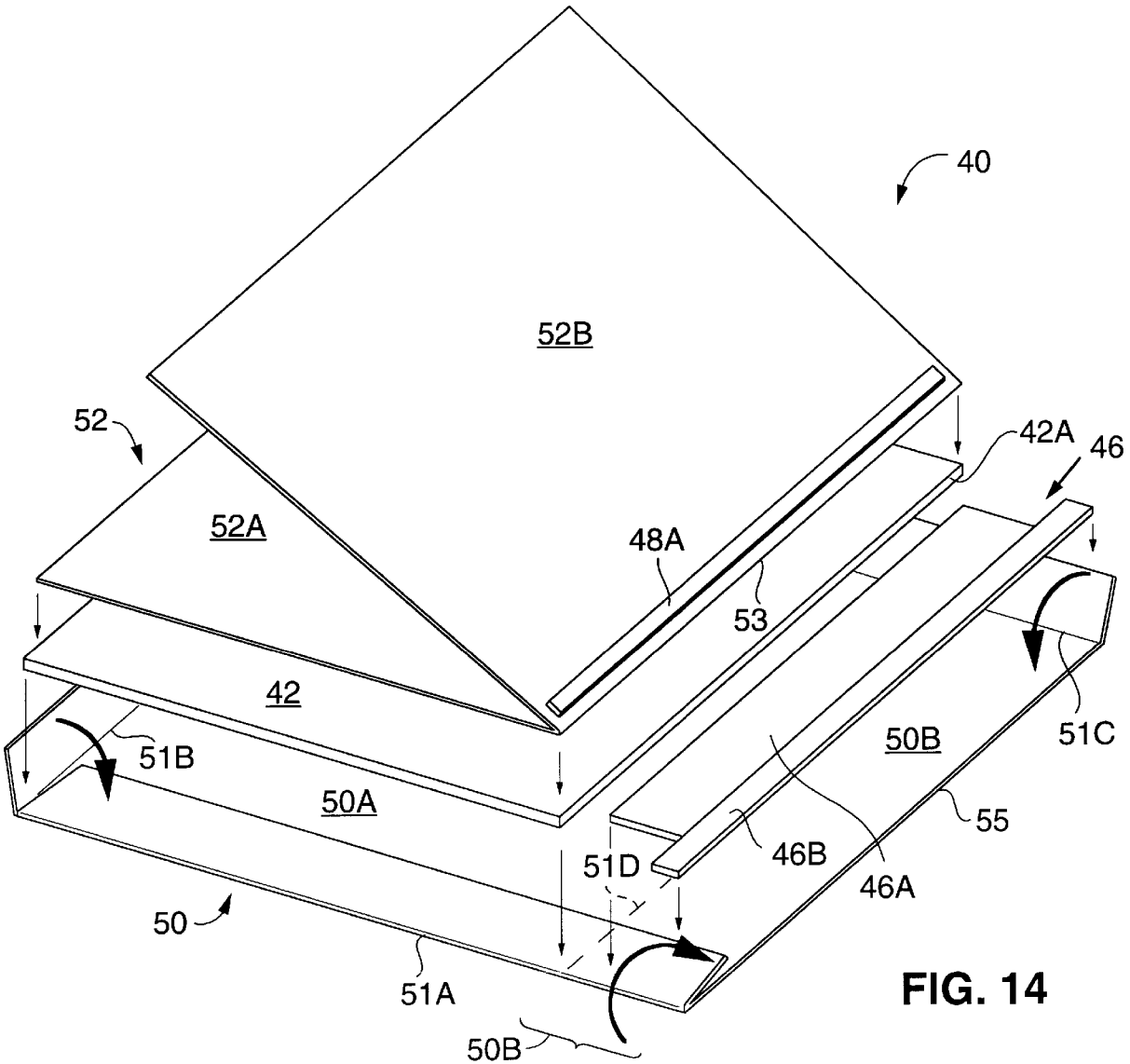
FIG. 14 is an exploded perspective view of the cover/spine assembly of a second embodiment of the present invention.
Figure 15:
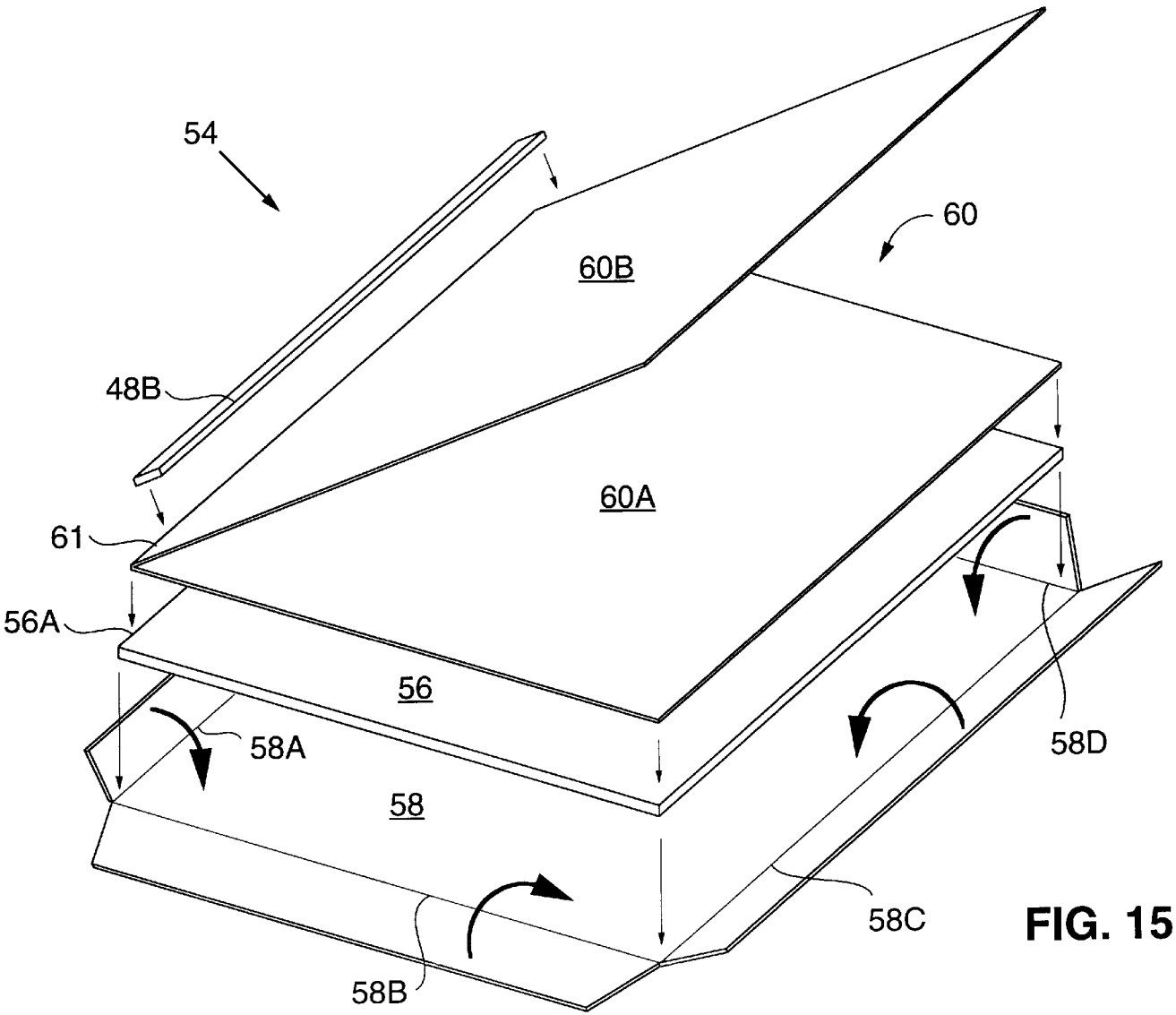
FIG. 15 is an exploded perspective view of the rear cover assembly of the second embodiment of the present invention.
Figure 16:
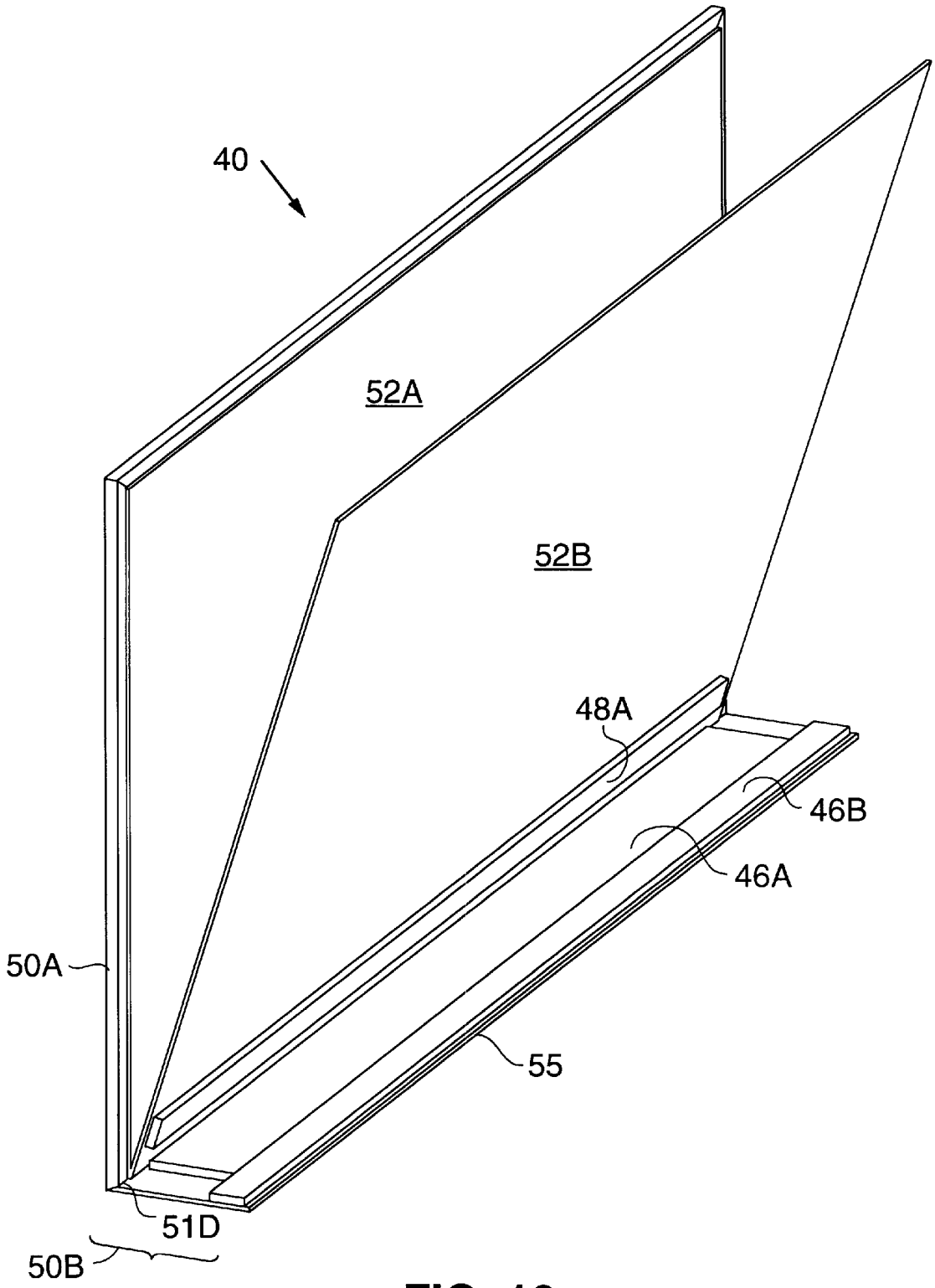
FIG. 16 is a perspective view of the cover/spine assembly of the second embodiment of the present invention.

FIGS. 14 through 17 depict a second embodiment bookbinding system which produces hardcover bound books. Referring to FIGS. 14 and 16, a spine/cover assembly, generally designated by the numeral 40, is shown in an exploded view. Assembly 40 includes a generally rigid front cover 42 (FIG. 14) of the type used in the manufacture of mass produced hardcover books. The spine/cover assembly 40 includes a cloth layer 50 which includes a cover section 50A that covers front surface of cover 42. Cloth layer 50 further includes spine section 50B which, as will be described, will be folded around the spine of the book and over a portion of the rear book cover. The cover and spine sections of the cloth layer 50 are separated by a fold line 51D.

Spine section 50B supports an adhesive matrix 46 which includes a central adhesive band 46A and an outer adhesive band 46B, with both bands extending down the length of the spine section. Outer band 46B, which provides a function similar to adhesive band 18C of the first embodiment, has the same length as front cover 42. As previously noted, an adhesive sold under the designation HB HL-1777 by the H. B. Fuller Company of St Paul, Minn. has been found suitable for this purpose. Central band 46A, which provides a function similar to that of central band 18B of the first embodiment, is somewhat shorter than the length of front cover 42 so that there will be a gap or space between each end of band 46A. These gaps, as was the case for similar gaps present on the first embodiment adhesive matrix, permits the low viscosity molten adhesive of band 46A to flow a short distance without being visible after the binding process is completed. Band 46A, like band 18B, is a low viscosity, heat-activated adhesive. Again, an adhesive made by National Starch & Chemical Company of Bridgewater, N.J. under the designation Cool-Bind 34-1301 has been found suitable for inner band 46A. It is also preferable that a thin layer (not depicted), typically 0.003 inches, of high viscosity adhesive being applied to the entire surface of the spine section 50B before application of the remaining adhesives of the matrix.

As was the case for the first embodiment, central band 46A should be at least as wide as the thickness of the stack to be bound. Typically, band 46A will be wider than the stack thickness depending upon the actual stack dimension. Further, the edge of central adhesive band 46A facing the front cover 42 should be spaced slightly away from fold line 51D to accommodate the thickness of the front cover 42 so that, when the front cover is rotated along line 51D until the cover is perpendicular to the spine section as shown in FIG. 16, the edge of band 46A will abut the edge of the front cover 42. This will ensure that the top sheets of the stack to be bound, those closest to the front cover, will contact the molten adhesive of central band 46A during binding.

Cloth layer 50 is dimensioned so that the layer can fully cover the outer surface of the rigid front cover 42 and so that there is sufficient material to permit the cloth layer to be folded around all edges of the cover 42 except edge 42A. The cloth layer 50 will be of sufficient width so that the layer will extend past fold line 51D, the point at which the layer will intercept edge 42A, a sufficient distance to edge 55 to form the spine section 50B of the desired width. As was the case of the first embodiment binding system, the second embodiment system is preferably produced in four different sizes (spine section widths) to accommodate the various stack thicknesses as set forth in Table 1, above.

The cloth layer 50 is attached to the front cover 42 using an adhesive which is applied both to the entire outer surface of the cover and to the margins of the inner surface of the cover. Cloth layer 50 is preferably a material commonly referred to as book cloth, with such material having a thin backing, such as paper, which acts as a barrier and prevents the adhesive which secures the layer 50 to the cover from saturating the cloth and thereby detracting from the appearance of the bound book.

Cloth layer 50 is folded around the margins of three edges of the front cover 42 at fold lines 51A, 51B and 51C. Cloth layer 50 is also folded over itself on line 51A and line 51C at the spine section 50B (between edge 55 and fold line 51D). The folded layers are glued together to form a single layer having a thickness equal to twice that of the cloth layers. The adhesive matrix 46 is disposed on the spine section 50B, over the two folded cloth layers at the two ends of the spine section.

A paper end sheet 52, folded in half at line 53 to form a cover section 52A and a fly leaf section 52B, is secured to the inner surface of the cover section 42 using an adhesive. The cover section and fly leaf section preferably both have the same length and width of the stack to be bound. The adhesive is applied to the inner surface of the cover section 52A, with the cover section 52A being positioned to cover all of the exposed edges of the cloth layer that are folded over the edges of the front cover 42. The fold line 53 of the end sheet 52 is positioned along the fold line 51D of the cloth layer. As can best be seen in FIG. 16, the cover section of 52A of the folded end sheet 52 covers the exposed periphery of the folded edges of the cloth layer 50 thereby enhancing the appearance of the bound book. Typically, rigid front cover 42 will be somewhat larger in terms of width and length than the stack to be bound. Since the cover section 52A of end sheet 52 is the same size as the stack, there will be an exposed cloth border on the inside of the cover, similar to that of a conventionally bound hardcover book.

A narrow adhesive strip 48A is disposed on the fly leaf section 52B, along fold line 53. Strip 48A is positioned close to fold line 53, with the distance between the strip 48B and fold line 53 depicted in FIG. 14 being exaggerated for purposes of clarity, as is the thickness of the adhesive strip itself. Strip 48A is preferably made of the same adhesive as used in the central adhesive band. The strip is made thin so that the strip is more easily melted during binding, with the strip typically being 1/32 to 1/8 inches wide and 0.002 to 0.010 inches thick. As will be explained, the adhesive strip 48A operates to bond the lower edge of the fly leaf section 52B to the lower edge of the top sheet of the stack to be bound. By securing the edge of the fly leaf section to the stack in this manner, the underlying adhesive of the adhesive matrix 46 concealed when the bound book is opened. This feature further enhances the appearance of the bound book. As will be explained later, an indentation is preferably formed in the outer surface of the front cover along fold line 51D. The cloth layer conforms to the indentation so as to further simulate the appearance of a hardback book bound using conventional techniques.

Figure 17:
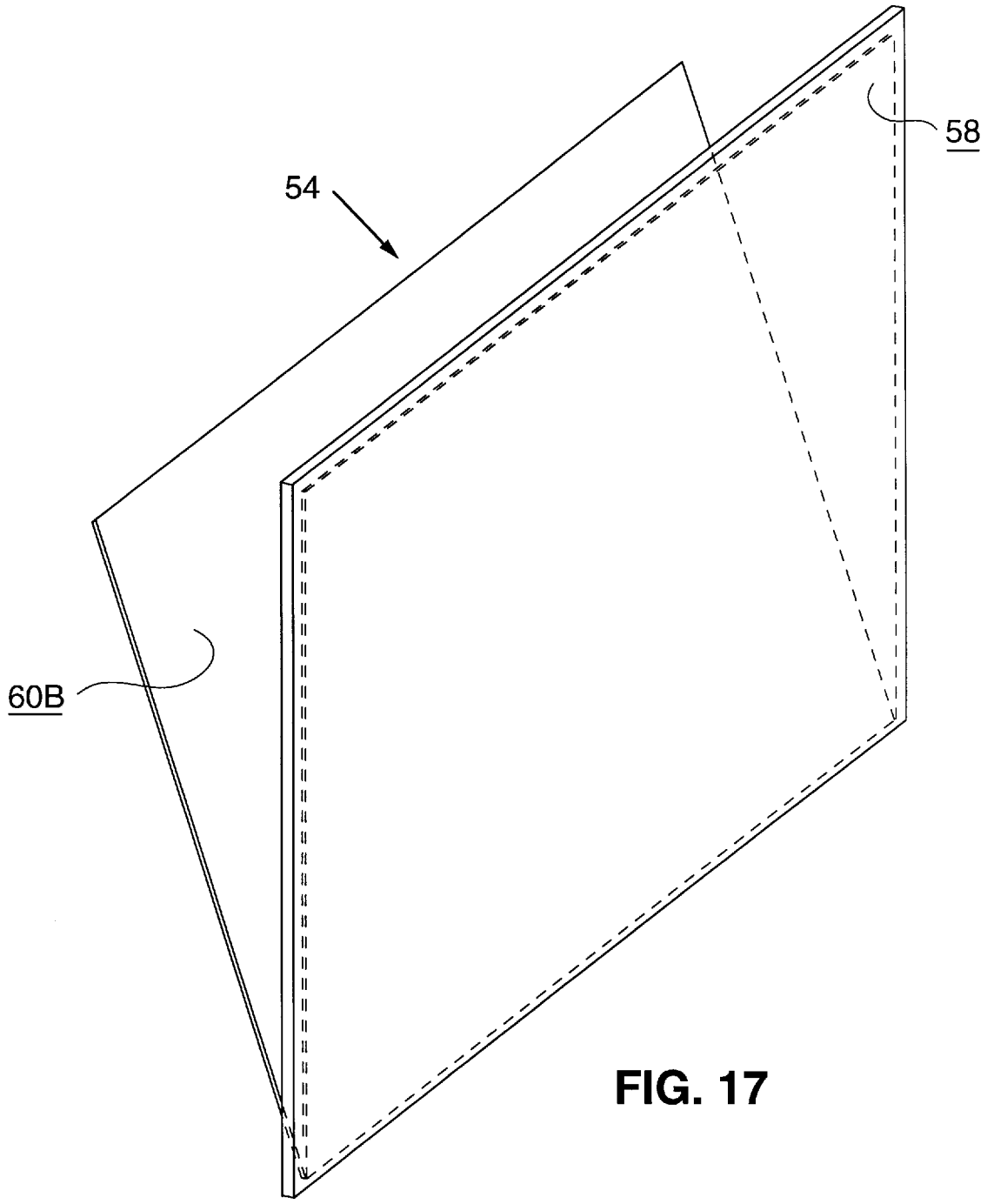
FIG. 17 is a perspective view of the rear cover assembly of the second embodiment of the present invention.

The back cover assembly 54 is shown in FIGS. 15 and 17. The assembly includes a rigid rear cover 56 having the same dimensions as the rigid front cover 42. The outer surface of the rear cover 56 is covered by a cloth layer 58 which matches cloth layer 50 of the front cover. Cloth layer 58 is larger that cover 56 so that the edges of the cloth layer can be folded around the four edges of cover 56 at fold lines 58A, 58B, 58C and 58D. An end sheet 60, identical to end sheet 52 of the front cover, includes a cover section 60A and a fly leaf section 60B. The cover section 60A is secured to the inside of the rear cover by way of an adhesive. The fold line 61 of the end sheet is disposed at edge 56A of the rigid cover. Thus, a cloth border is produced at three edges of the rigid cover to simulate the appearance of a conventionally bound book.

A thin adhesive strip 48B, similar to strip 48A, is positioned on the fly leaf section 60B, along the fold line 61 of end sheet. During the binding sequence, the adhesive strip 48B will become molten and will form a bond between the fly leaf section 60B and the last sheet of the stack. Again, this feature conceals the underlying adhesive of matrix 46 thereby enhancing the appearance of the book.

The process of binding a stack using the second embodiment system is similar to the process previously described in connection with the first embodiment. A cover/spine assembly 40 having a spine section 44 of a width appropriate for the width of the stack to be bound is first selected in accordance with Table 1. As was the case with the first embodiment, the spine section 50B should be wider that the thickness of the stack to be bound so that the spine section can be wrapped around the edge of the stack, with the edge of every sheet of the stack being positioned opposite some portion of the central adhesive band 46A. Further, the spine section width must be such that outer adhesive band 46B will be fully engaged by rotating section 32B of the heated platen as shown in FIG. 10. If the spine section 50B is too wide, the adhesive band 46B will be positioned too high on the back cover assembly 54 to be engaged by rotating section 32B. If the spine section is too narrow, it is likely that last sheets of the stack to be bound will not be positioned over the central adhesive band 46A so that the sheets will not be adequately secured.

One the appropriate cover/spine assembly 40 has been selected, the back cover assembly 54 is positioned over the last page of the stack to be bound. Next, the stack and back cover assembly are placed over the cover/spine assembly 40. The spine section 50B is then folded under the edge of the stack, along fold line 51D, similar to the configuration shown in FIGS. 5 and 6. The arrangement is then inserted into a conventional desktop binding machine, with the sequence shown in FIGS. 7A, 7B, 8, 9, 10 and 11 being carried out automatically. As represented by FIG. 10, the outer portion of the spine section 50B, including side adhesive band 46B, will be forced against the lower portion of the back cover assembly 54. The side adhesive 46B will form a bond between the cloth layer 58 on the rear cover and the cloth layer of spine section 50B. The edge of the spine section cloth layer will remain exposed but will not be readily apparent assuming that the compressed adhesive has been transferred up to but not past, the edge. The heat from the binding sequence will operate to activate the two adhesive strips 48A and 48B so that the first and last sheets of the stack will be secured to the front and rear fly leaf sections 52B and 60B, respectively. Adhesives 46A and 46B will be activated in a manner similar to that of the first embodiment adhesives 18B and 18C and will perform substantially the same functions.

Figure 18:
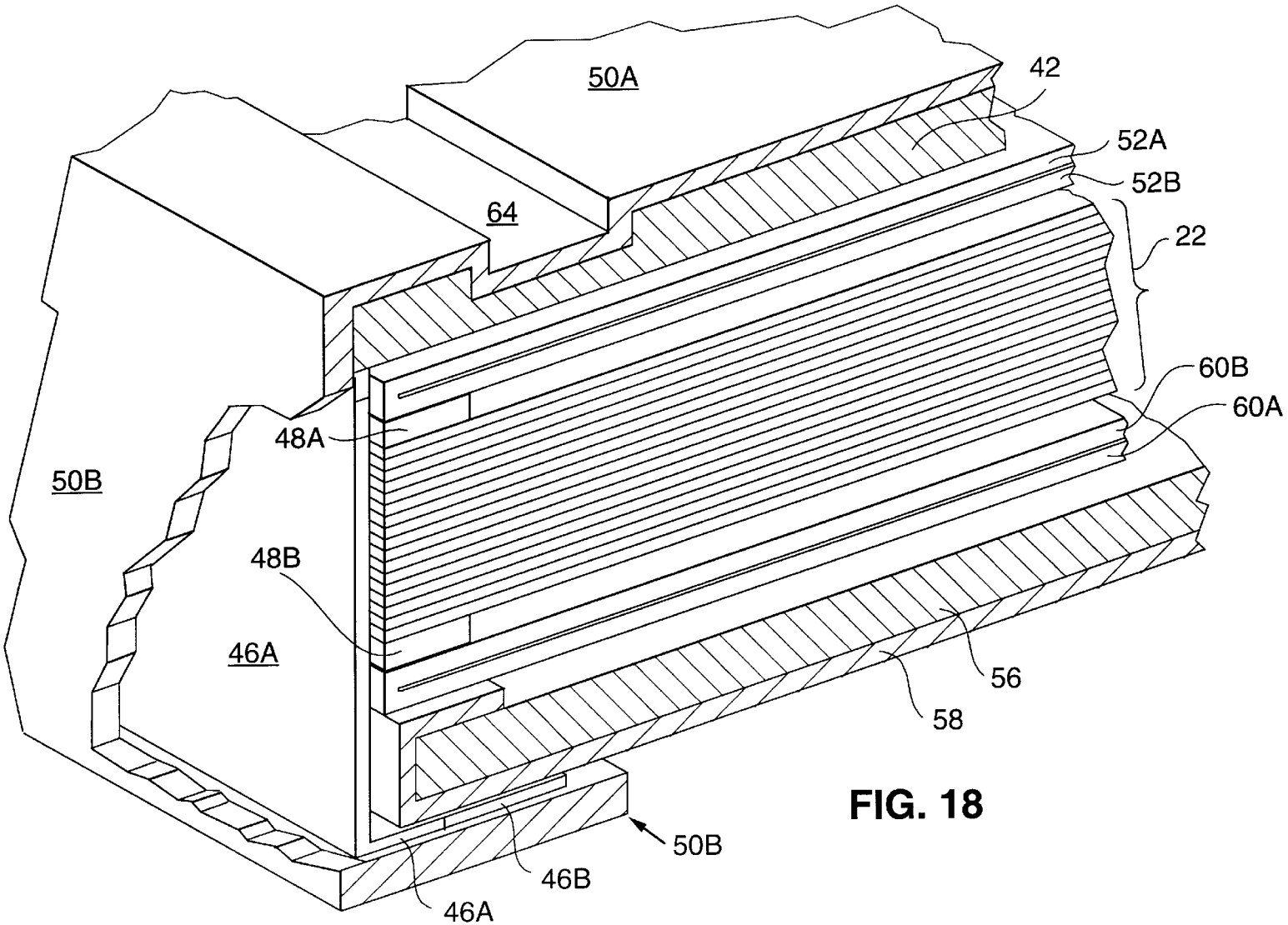
FIG. 18 is a perspective, cross-sectional view of the spine of a book bound in accordance with the second embodiment of the present invention.
Figure 19:
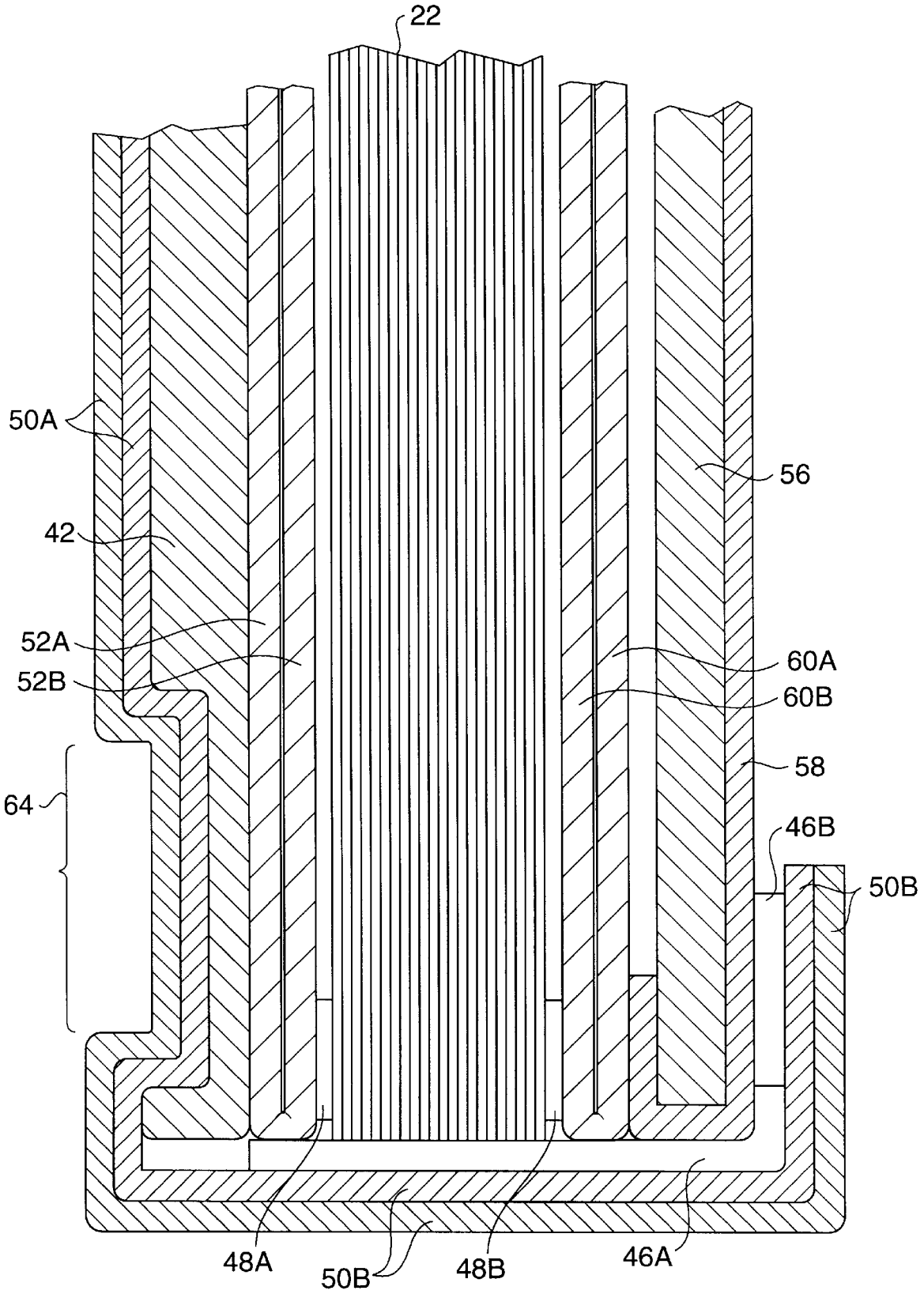
FIG. 19 is a fragmentary end view of the spine of a book bound in accordance with the second embodiment of the present invention.

FIG. 18 is perspective cross-sectional view of the spine portion of the final bound book using the second embodiment binding system. FIG. 19 is a fragmentary end view of the same book, with part of the spine section 50B cut away. The previously noted indentation 64 for simulating the appearance of a hardcover book bound using conventional techniques is shown in both figures. The views are not to scale, with certain dimensions being exaggerated for purposes of clarity. By way of example, FIG. 19 shows adhesive 46B, after the binding process, securing the two layers 50B/50B of cloth of the spine section to the cloth layer 58 of the back cover assembly 54. Adhesive layer 46B, after binding, will be relatively thin, as will be to two layer of cloth 50B/50B so that the terminal edge of the spine section cloth on the rear cover cloth 58 will be much less discernable than depicted.

Thus, novel bookbinding structures and method have been disclosed. Although two embodiments have been described in some detail, it is to be understood that various changes can be made by those skilled in the art without departing from the spirit and scope of the invention as defined by the appended claims. By way of example, cloth layer 50 could be replaced with a paper layer if desired. In addition, fly leaf sections 52B and 60B can be replaced with fan-folded fly leaf sections. In that event, the fly leaf sections, prior to folding, have the same length but have a larger width than the stack. The front and back fly leaf sections are each folded over on itself multiple times so that each folded fly leaf section has the same length and width as the stack. Typically, a first fold is formed at the same location and in the same direction as fold line 61 of the back cover end sheet 60 (or fold line 53 of the front cover end sheet 52). A second fold is formed at a location at perhaps half the width of the stack away from fold line 61 and in a direction opposite the first fold line so that the fly leaf section then overlies the first fold line. Finally, a third fold is formed along a line which overlies fold line 61 and which is in the same direction as the first fold line and which terminates at the opposite edge of the stack as the same location that the original fly leaf section terminated. This produces a fan-folded fly leaf section, with adhesives 48A and 48B being disposed on the fly leaf sections so as to engage the first and last sheets of the stack in the same location as the original fly leaf sections.

What is claimed is:

1. A bookbinding system for binding a stack of sheets, with the stack having a length, a width and a thickness, said system comprising:

a cover/spine assembly which includes (a) a relatively rigid first cover section having a width at least as great as the width of the stack and a length at least as great as great as the length of the stack and (b) a spine section having a length which corresponds to the length of the first cover section and a width which is greater than the thickness of the stack with a first edge of the spine section along the length of the spine section being secured to a first edge of the first cover section along the length of the first cover section so that the spine section can be folded with respect to the first cover section; and an adhesive matrix disposed on the spine section, said adhesive matrix including a heat-activated, relatively low viscosity, central adhesive band extending along the length of the spine section and a heat-activated, relatively high viscosity outer adhesive band extending along the length of the spine section intermediate the central adhesive band and a second edge of the spine section, opposite the first edge.

2. The bookbinding system of claim 1 wherein the cover/spine assembly includes a flexible layer which covers an outer surface of the first cover section and which extends from the first cover section to the spine section, with the flexible layer securing the first cover section to the spine section.

3. The bookbinding system of claim 2 wherein the flexible layer includes a cloth layer.

4. The bookbinding system of claim 2 further including a first end sheet which includes a first section having a length and width that correspond to the length and width of the stack, with a first edge of the first section of the first end sheet being secured to the first cover section along the length of the first cover section.

5. The bookbinding system of claim 4 further including an adhesive band disposed at the first edge of the first section of the first end sheet on a surface of the first section of the first end sheet opposite the first cover section.

6. The bookbinding system of claim 5 further including a relatively rigid second cover section, separate from the cover/spine assembly, having a length and width that corresponds to the length and width, respectively, of the first cover section.

7. The bookbinding system of claim 6 further including a second end sheet which includes a first section having a length and width that correspond to the length and width of the stack, with a first edge of the first section of the second end sheet being secured to the first cover section along the length of the first cover section.

8. The bookbinding system of claim 7 further including an adhesive band disposed at the first edge of the first section of the second end sheet on a surface of the first section of the second end sheet opposite the second cover section.

9. The bookbinding system of claim 8 wherein the second cover section includes a flexible layer which covers an outer surface of the second cover section.

10. The bookbinding system of claim 9 wherein the flexible layer of the second cover section includes a cloth layer.

11. The bookbinding system of claim 10 the flexible layer of the cover/spine assembly matches the flexible layer of the second cover section in appearance.

12. A method of binding a stack of sheets comprising:

providing a cover/spine assembly which includes a relatively rigid first cover section and a spine section, with the spine section having a length that corresponds to a length of the first cover section and a width that is greater than a thickness of the stack to be bound, with spine section being secured to the first cover section along the length of the spine section and the first cover section;

providing a relatively rigid second cover section having a width and length that correspond to the length and a width, respectively, of the first cover section;

positioning the second cover section adjacent a first side of the stack;

positioning the first cover section adjacent a second side of the stack;

folding the spine section around a first edge of the stack and over only a portion of the second cover section;

forming an adhesive bond between the spine section and the first edge of the stack; and forming an adhesive bond between the spine section and the portion of the second cover section.

13. The method of claim 12 wherein the forming an adhesive bond between the spine section and the first edge of the stack includes applying heat and pressure.

14. The method of claim 12 further including providing first and second end sheets, with each end sheet including first and second sections, each section having a length and width that correspond to the length and width, respectively, of the stack; securing a first edge of the first section of the first end sheet to first cover section along the edge of the first cover section adjacent the spine section; securing a second first edge of the first section of the second end sheet along a first edge of the second cover section; wherein the step of positioning the second cover section includes positioning the first edge of the cover section adjacent the first edge of the stack; forming a bond between the first section of the first end sheet, near the first edge, and the stack and forming a bond between the first section of the first end sheet, near the first edge, of the stack.

15. The method of claim 13 wherein the forming an adhesive bond between the spine section and the second cover section includes applying heat and pressure.

16. A bookbinding system for binding a stack of sheets, with the stack having a length, a width and a thickness, said system comprising:

a cover/spine assembly which includes (a) a first cover section having a width at least as great as the width of the stack and a length at least as great as the length of the stack;

(b) a first flexible layer which covers a first side of the first cover section and which extends past a first edge of the first cover section a distance greater than the thickness of the stack so as to form a spine section;

a second cover section, separate from the cover/spine assembly;

a second flexible layer, separate from the first flexible layer, which covers a first side of the second cover section;

a first end sheet which is folded into first and second sections along a fold line, each of the first and second sections having a length and width that corresponds to the length and width of the stack, with the first section being affixed to the second side of the first cover section so that the fold line is disposed along a first edge of the cover section located adjacent the spine section; and an adhesive band disposed on the second section along the fold line and on a side of the second section opposite the first cover section.

17. The bookbinding system of claim 16 further including a second end sheet which is folded into first and second sections along a fold line, each of the first and second sections having a length and width that corresponds to the length and width of the stack, with the first section being affixed to the second side of the second cover section so that the fold line is disposed along a first edge of the second cover section having the length that is at least as great as the length of the stack, an adhesive band disposed on the second section along the fold line and on a side of the second section opposite the second cover section.

18. The bookbinding system of claim 17 wherein the adhesive matrix and the adhesive bands include a heat activated adhesive.

19. A bookbinding system for binding a stack of sheets, with the stack having a length, a width and a thickness, said system comprising:

a cover/spine assembly which includes (a) a first cover section having a width at least as great as the width of the stack and a length at least as great as the length of the stack;

(b) a first flexible layer which covers a first side of the first cover section and which extends past a first edge of the first cover section a distance greater than the thickness of the stack so as to form a spine section;

a second cover section, separate from the cover/spine assembly;

a second flexible layer, separate from the first flexible layer, which covers a first side of the second cover section;

an adhesive matrix disposed on the spine section and positioned on the spine section such that the adhesive matrix is capable of both securing the first and second flexible layers to one another and securing the spine section to an edge of the stack of sheets;

a first end sheet which is folded into first and second sections along a fold line, each of the first and second sections having a length and width that corresponds to the length and width of the stack, with the first section being affixed to the second side of the first cover section so that the fold line is disposed along a first edge of the cover section located adjacent the spine section; and an adhesive band disposed on the second section along the fold line and on a side of the second section opposite the first cover section.

20. The bookbinding system of claim 19 further including a second end sheet which is folded into first and second sections along a fold line, each of the first and second sections having a length and width that corresponds to the length and width of the stack, with the first section being affixed to the second side of the second cover section so that the fold line is disposed along a first edge of the second cover section having the length that is at least as great as the length of the stack, an adhesive band disposed on the second section along the fold line and on a side of the second section opposite the second cover section.

21. The bookbinding system of claim 20 wherein the adhesive matrix and the adhesive bands include a heat activated adhesive.

* * * * *